United States Patent [19]

Leitch

[11] Patent Number: 4,839,527

[45] Date of Patent: Jun. 13, 1989

[54] OPTICAL-FIBRE SMOKE DETECTION/ANALYSIS SYSTEM

[76] Inventor: Alan Leitch, 11 Hampden Street, Beverly Hills 2209, New South Wales, Australia

[21] Appl. No.: 113,556

[22] Filed: Oct. 27, 1987

[30] Foreign Application Priority Data

Oct. 28, 1986 [AU] Australia ..... PH8724

[51] Int. Cl.[4] ..... G08B 17/10

[52] U.S. Cl. ..... 250/573; 250/574; 250/227; 340/630

[58] Field of Search ..... 250/227, 573, 574; 340/630; 356/438, 439

[56] References Cited

U.S. PATENT DOCUMENTS 3,805,066 4/1974 Chijuma et al. ..... 340/630

4,443,700 4/1984 Macedo et al. ..... 250/227

4,491,830 1/1985 Miyabe ..... 340/630

4,647,786 3/1987 Güttinger ..... 250/574

*Primary Examiner*—David C. Nelms

*Assistant Examiner*—Stephone B. Allen

*Attorney, Agent, or Firm*—Amster, Rothstein & Ebenstein

[57] ABSTRACT

A sensor system for the detection and/or analysis of smoke, gas or the like, comprising a detection means 6 connected to an analyser means 2 via fiber-optic links 3, 11 and 12. The detector 6 determines the presence of smoke, gas or the like, while the analyzer 2 analyzes the composition of the smoke, gas or the like. The exact location and nature of the smoke, gas or fire can therefore be determined with the aid of suitable associated circuitry 9.

11 Claims, 9 Drawing Sheets

OPTICAL-FIBRE SMOKE DETECTION/ANALYSIS SYSTEM

The present invention relates to the field of fibre-optic technology, to spectrophotometry and reflectometry, and more particularly to their application to a sensing system for the detection and analysis of smoke, gas or the combustion products of fire.

The technology of fibre-optics finds application in a wide variety of fields, most notably in the communications and medical fields. The principal reasons for the explosive growth of the fibre-optics industry are due to the low loss, wide bandwidth communication achievable using optical fibres. Other unique characteristics of optical fibers include their immunity to electromagnetic interference and their ability to withstand high temperature environments. All these characteristics render the optical fibre as an ideal component in a smoke, gas and fire detecting system in accordance with the arrangement of the present invention.

The science of spectrophotometry allows the composition of a sample gas to be determined. A spectrophotometer, in the strict sense, is a device for measuring the distribution of electromagnetic energy over a spectrum. Basically, a spectrophotometer consists of a light source, chosen for the special range of interest, a sampling cell, a detector and a readout device. Measurements may be carried out at particular wavelengths of interest, or the spectrum may be scanned automatically and a graph or printout of the absorption/emission at various wavelengths produced.

Gaseous molecules have natural frequencies of vibration, so each type of molecule absorbs electromagnetic radiation in different wavebands. Spectra of gases are therefore unique to particular gases, so, by mapping their transmission at various wavelengths the composition of a sample gas may be deduced. Spectrophotometery has particular application to this invention in that not only can the presence of smoke, gas, and/or the combustion products of fire be detected, but the particular composition and nature of the smoke, gas or fire can be analysed.

This renders the present invention particularly useful in a wide variety of applications including chemical and gas manufacturing and processing plants, where not only is the presence of fire able to be detected, but also, unusually high concentrations of gases or chemical vapors may be detected and analysed.

Reflectometry is also utilised in the present invention to provide an integrated sensing system. Since fibre-optic cables have a finite velocity constant, and the transit time of a pulse of electromagnetic energy of specific wavelength through a network of fiber-optic cables and detection cells can be measured accurately, the transmission of such a pulse through a network and the detection of the returned signal relative to a time frame and the measurement of the amplitude of the signal at specific wavelengths, allows the exact location and the nature of the smoke, gas or fire to be determined by the microprocessor. The location of the smoke, gas or fire, (combustion products), may then be signaled by digital communication over optical fibre or other communication media, as may be appropriate to a given installation, to a central watching station where an appropriate alarm is raised. Mimic diagrams/computer generated displays of the floor plan, specific instructions for those premises in the event of alarm are activated, and the location and type of the smoke, gas, or combustion products of fire are displayed.

The present invention seeks to provide a sensing system for detection and analysis of smoke, gas or fire.

The present invention also seeks to provide an intrinsically safe smoke, gas and fire sensing system which is capable of withstanding high temperature environments with no adverse effects.

The present invention also seeks to provide a smoke, gas and fire sensing system which does not only detect the presence of smoke, gas and fire, but also is able to analyze the exact nature of said smoke, gas or fire.

The present invention also seeks to provide a smoke, gas and fire sensing system, which is capable of not only detecting the presence of fire within a particular environment, but is also able to pin-point the exact location of said smoke, gas or fire.

In one broad form, the present invention provides a sensor system comprising:

detection means having at least one detection cell for the detection of smoke, gas or the like; and, analyser means opto-electrically connected to each of said detection cells of said detection means via an optical fiber link for determining the presence of said smoke, gas or the like detected by said detection means.

The present invention will become more fully understood by consideration of the following detailed description of preferred embodiments thereof in connection with the accompanying drawings, in which:

FIG. 1 shows a preferred embodiment of the sensing system of the present invention;

FIGS. 2*a* and 2*b* illustrated an embodiment of a simple detection cell for the detection of gas, smoke or the like;

FIG. 3 details the manner in which an optical fibre is mounted in the rear of a parabolic mirror of the detection cell of FIG. 2;

Figures 8A, 8B, 8C:
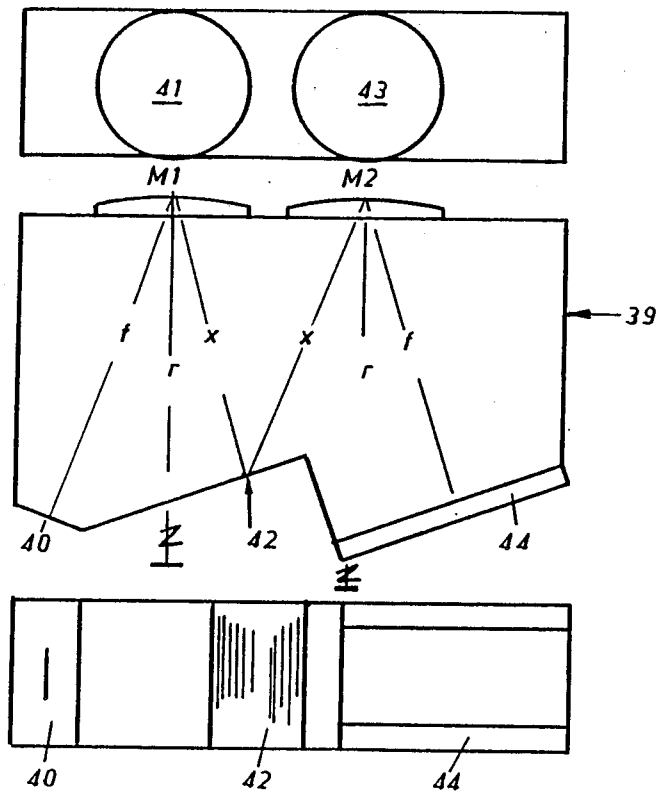
Figure 9A:
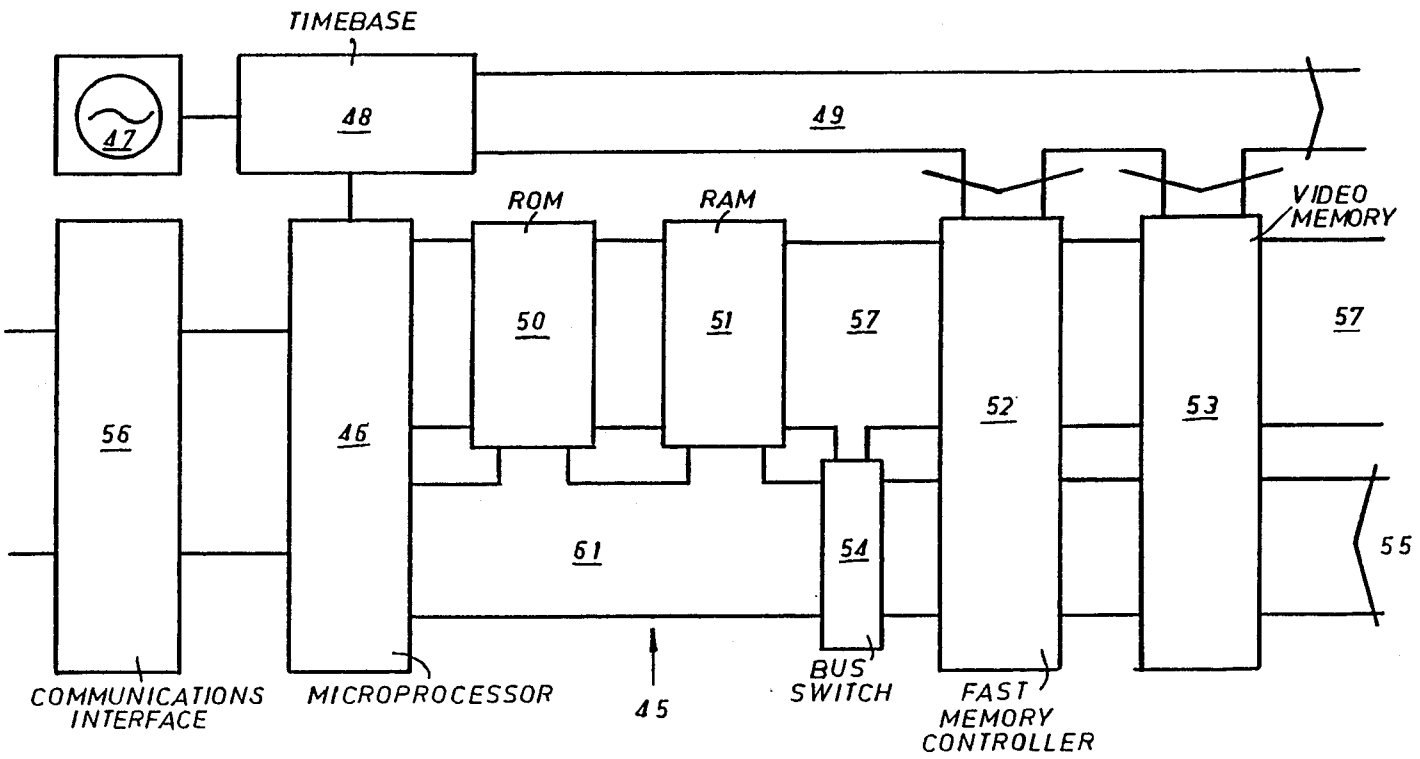
Figure 9B:
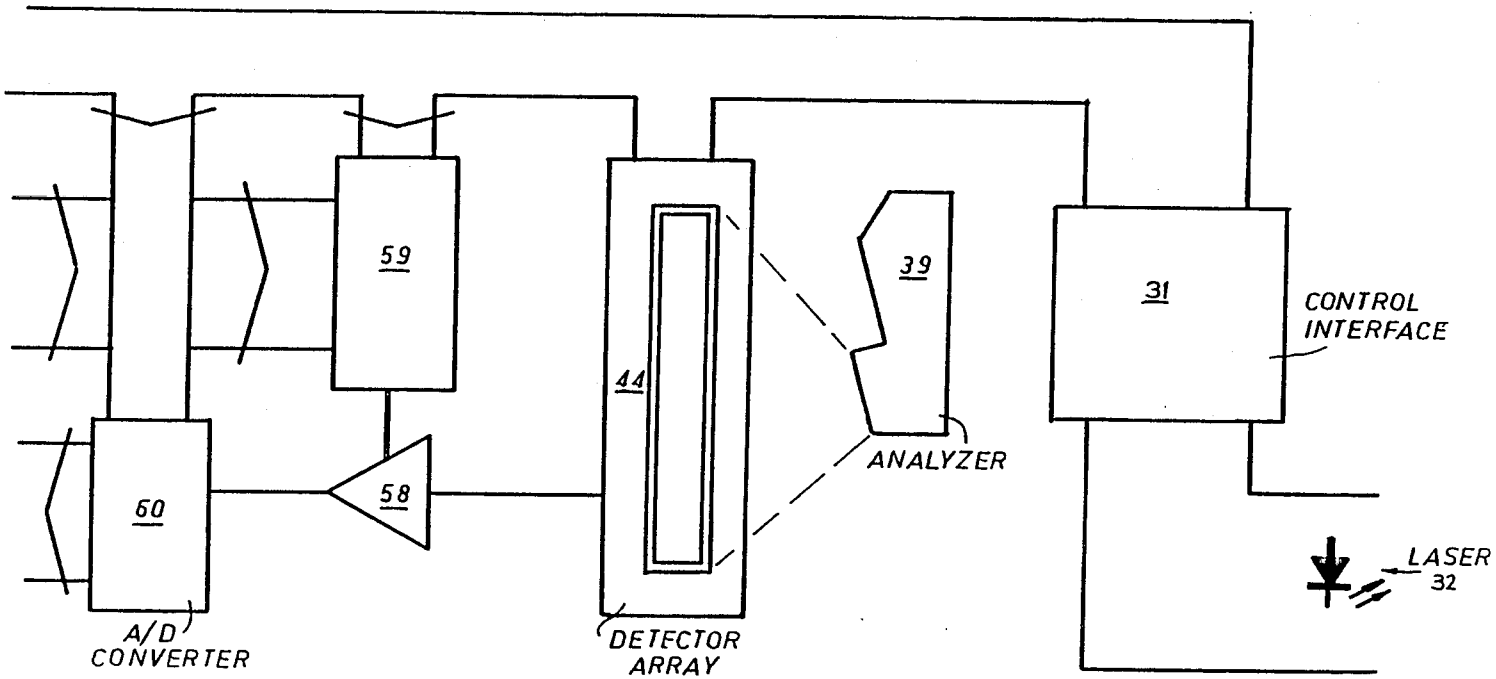
Figure 10A:
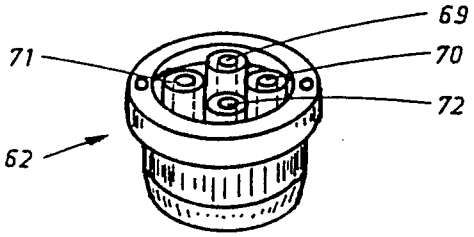
Figure 10C:
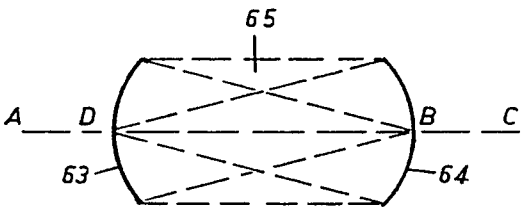
Figure 10B:
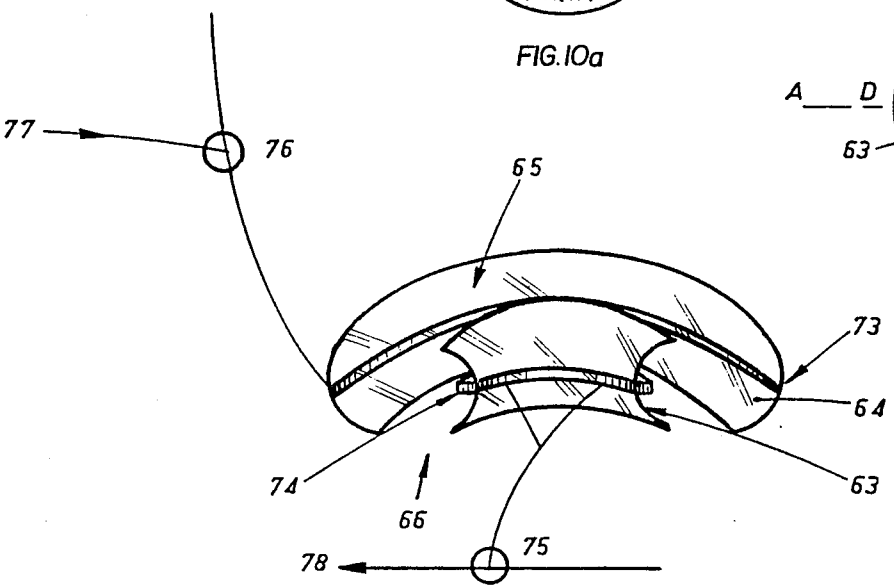

FIG. 8 details an embodiment of an optical spectrophotometer analyzer suitable for analyzing the composition of gas, smoke or the like;

FIG. 9 details a block diagram of a microprocessor and the associated control logic for the transmission and reception and analysis of the electromagnetic radiation; and, FIG. 10 shows a detection cell designed in the shape of a torus, illustrating a preferred embodiment thereof.

Figure 1:
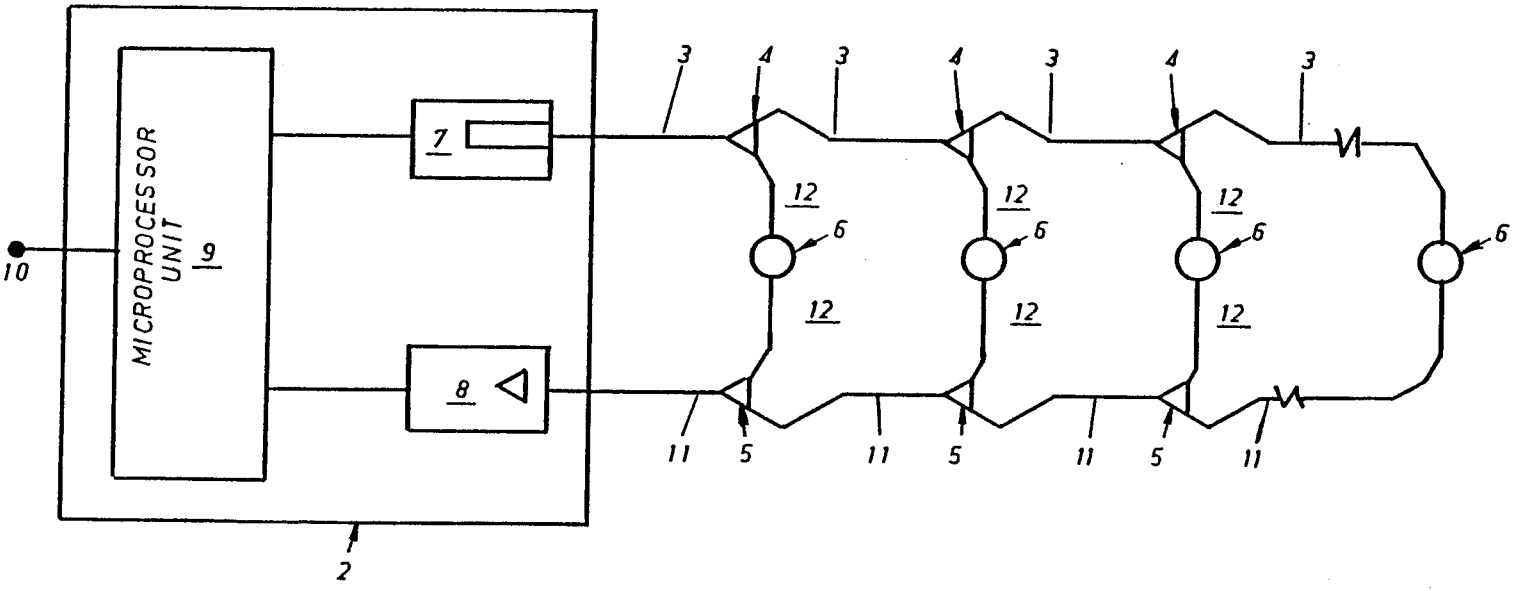

In FIG. 1, the sensor system is comprised of detection means, generally designated by the numeral 1 and analyzer means, generally designated by the numeral 2. The present embodiment shows the detector 1 comprising a plurality of fiber-optic cables 3, 11, 12, a plurality of fiber-optic splitters 4, fiber-optic combiners 5, and a plurality of detection cells 6. The analyzer 2 comprises a light source 7, a receiver 8 and a microprocessor 9. A communications link 10 links the system to a control panel, alarm or the like to indicate the presence of smoke, gas or fire to an operator.

In operation, the coherent light source 7, which may, for instance, be a laser or a laser diode, emits a pulse of electromagnetic energy into the fiber-optic cable 3. If more than one detection cell 6 is required, a fiber-optic splitter 4 is used to direct part of the energy into the detection cell 6 via optical fiber 12 and part of the energy to the next detection cell stage. The detection cell 6, which will be described hereinafter in more detail, detects the presence of smoke, gas or the like by changing the spectral properties of a pulse of electromagnetic energy. The resultant electromagnetic energy conducted out of the detection cell 6 is returned via the fiber-optic combiner 5 from each of the detection stages. The resultant electromagnetic energy returned to the receiver 8 is then supplied to the microprocessor 9 for processing and analysis.

By changing the wavelength of the light source 7, the presence and concentration of gas, smoke or the like can be identified by the attenuation of the signal as it travels through the detection cell. It is also possible to determine the presence of particular substances by the stimulated emission. of electromagnetic radiation of certain wavelengths following the application and removal of the pulse of electromagnetic energy. This may be determined by sensing both the absorption and emission spectra of the substance in the detection cell 6.

The analyzer 2 utilizes time domain reflectometry to determine the particular location of the smoke, gas or fire.

The nature of the smoke, gas or fire is determined by controlling the wavelength of the emitted light source to identify particular substances and the concentrations thereof at the detection cells 6. The microprocessor unit 9 may be programmed to control the transmission of a particular sequence of electromagnetic signals from the light source 7. The resultant electromagnetic signal returned to the receiver 8 may then be compared to the transmitted signal and analyzed by spectrophotometery to identify the particular substances and their concentrations.

The particular location of the smoke, gas or the like is calculated by the microprocessor 9 by measuring the time elapsed between the transmission of the electromagnetic energy pulse from the source 7 and the reception of the resultant electromagnetic energy pulse at the receiver 8. Since the fiber-optic cable transmission is of finite velocity, a pulse of electromagnetic energy will take a finite time to traverse the optical path to and from each detector cell 6. By measuring the time elapsed between transmission and reception of an electromagnetic energy pulse, it is therefore possible to determine which detection cell the pulse travelled through, and thus the exact location of the smoke, gas or fire.

The microprocessor 9 controls the emission of the pulses of electromagnetic energy from the coherent light source 7 as well as analyzing the resultant electromagnetic energy returned to the receiver, to determine both the nature of the smoke, gas or fire as well as the particular location of the smoke, gas or fire. The microprocessor is preferably packaged in a gas-tight/explosion-proof housing in hazardous environments. The communications within the microcomputer may be either made by optical fibers or hardwired.

The function of the device is inherently fail-safe and intrinsically safe, in that a pulse of light of known spectra is transmitted through a fiber-optic cable to a detection cell in which the said pulse of light is used to probe the absorption and emission spectra of gaseous substances which may be present in the detection cell. Certain wavelengths of light will be absorbed by the normal atmosphere in the detection cell and by the fiber-optic cable. However these absorptions will be known and this information is used as a reference of the normal or non-fire state. The light pulse is returned by another fiber-optic cable or by reflection into the first fiber-optic cable to an analysing system which can determine which wavelengths have been absorbed and from this information determine the molecular signature of the substance in the detection cell and its concentration.

For example, in the early stages of certain fires there is an abrupt increase in the presence of hydroxyls which have a strong absorption lines at certain infra-red wavelengths. Absorption at these wavelengths can be detected with the apparatus described below.

The light source employed in this device may be a broad spectrum source such as a xenon flash tube which has a known spectra, a carbon dioxide laser which has been designed to produce a comb spectra, or a multiplicity of hetero-junction lasers of different wavelengths, the outputs of which have been optically combined to produce a pulse or pulses of light of the desired spectra or any other light source of known spectra. The selection of the light source is dependant on the application of the detection system and the absorption and emission spectra of the gaseous substances of interest.

In FIG. 2, is shown an embodiment of a simple detection cell 6. The detection cell 6 in FIG. 2(*a*) comprises two cassegrain parabolic mirrors 13 and 14 facing each other with the focal point of each mirror falling in the centre of each opposing mirror. The optical fibers 15 and 16 enter the rear of the center of each mirror 13 and 14 on the focal axis, as shown more clearly in FIG. 3. FIG. 2(*b*) shows a variation of the detection cell 6, to improve the coupling. Interferance rings occur within the detection cell 6 due to interaction of wavefronts at the intersection of the dispersion angle of the optical fiber and the angle of the focal core of the mirror. FIG. 2(*b*) shows the inclusion of a probe 67 and an obscuration disc 68, consequently making the arrangement directional.

Figure 3:
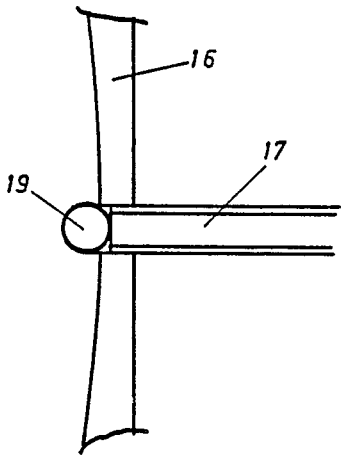

In FIG. 3, the optical fiber 17 is shown entering the rear of the parabolic mirror 16. A microsphere 19 receives the electromagnetic energy such that it provides an efficient interface to receive the electromagnetic energy for further transmission through the optical fiber 17. An identical construction may be used to transmit the electromagnetic energy from the optical fiber to the detection cell 6. The detection cell 6 is preferably mounted in a labyrinthine housing such that all ambient light and dust particles are excluded, whilst admitting gaseous substances.

The detection cell, in its simplest form, is an arrangement of two identical, opposing, concave mirrors mounted on a common axis and separated by a distance which is slightly less than the focal length of the mirrors to ensure stability of the arrangement.

Electromagnetic energy is coupled into the detection cell via a co-axially mounted optical fiber on the same axis as the mirrors and coupled out of the cell by a similar arrangement on the opposing mirror. To ensure maximum coupling efficiency the position of the output fiber on the mirror axis is adjusted in manufacture such that it falls at the focus of the interference rings which occur within the detection cell. A short focal length lens may be inserted in the optical path at this point to further increase the coupling efficiency. The inclusion of an obscuration disc on the axis of the mirrors between the input fiber and output probe attenuates direct rays on the axis and minimizes reflections into the input fiber which could disturb the operation of the system. This is, in effect, an optical directional coupler.

In most applications of this invention it is desirable, for both economic and engineering considerations, that a multiplicity of detection cells be connected to one fiber-optic highway. This is achieved by the insertion of fiber-optic splitter combiners in the transmit and receive optical fibers at the desired detection location. It also provides an economical method whereby detection cell/s, which is/are geographically removed from the main fiber-optic highway, may be connected on a spur fiber-optic circuit. The fiber-optic splitter combiners have been designed as an integral part of the detection cell assembly to simplify installation of the system. They also provide a method to prevent reflections, which occur at interfaces of differing refractive indices, from disturbing the operation of the system. The splitter combiners are directional devices in that the gradient of the refractive index changes along the length of the device, that is, there is an abrupt change to a higher refractive index in the core of the optical fiber at the input end of the device, followed by a gradual decrease in refractive index along the length of the device, such that, at the output end, the refractive index is equal to that of the core of the optical fiber.

By controlling the refractive index in this manner it is possible to construct a number of useful optical devices which have application to this invention. Such devices include; circulators, directional couplers, signal splitter combiners and optical impedance matching devices.

These devices are used, individually or in combination, to direct the returning light pulse on to the return fiber-optic highway and thence to the analyzer.

Figure 4:
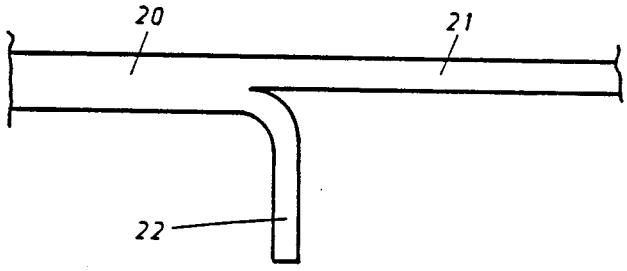
FIG. 4 shows the operation of a fiber-optic splitter/-combiner.

In FIG. 4 is shown a detail of an optical fiber splitter/combiner. In the case when it is being used as a splitter, one end 20 is mounted adjacent the light source, whilst the other ends 21 and 22 are both illuminated with minimal losses. When using it as a combiner, the ends 21 and 22 are utilised as the inputs, and the output is end 20.

Figure 5:
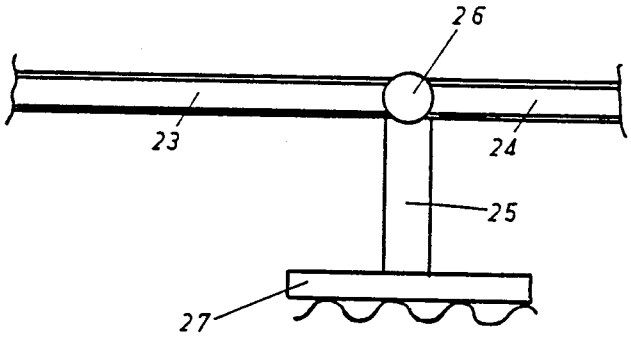
FIG. 5 illustrates a temperature sensor which may be used in conjunction with the present invention if information regarding the temperature is to be monitored.

In FIG. 5, a temperature sensor is shown. A temperature sensor may be utilized in connection with the sensing system to provide data on the change of temperature at a remote location, due to, for example, heat build-up caused by a fire. The temperature sensor can be connected by an optical fiber link to the microprocessor 9 for analysis. The temperature sensor comprises the input fiber 23 and the output fiber 24 connected together with a microsphere of temperature dependent optical material 26. The microsphere is connected via a thermal connection 25 to a thermal sensing plate 27. As the ambient temperature changes, the thermal sensing plate 27 recognizes this change and conveys same to the microsphere 26 via the thermal connection 25. The optical properties of the microsphere 26 of temperature dependent optical material consequently change, thus altering the optical properties of the path between the optical fibers 23 and 24. The microprocessor 9 can then analyse the differences between the electromagnetic energy supplied to the optical fiber 23 and the electromagnetic energy received at the output of the optical fiber 24. The temperature, or the rate of change of temperature may consequently be determined by calculation within the microprocessor.

Figure 6:
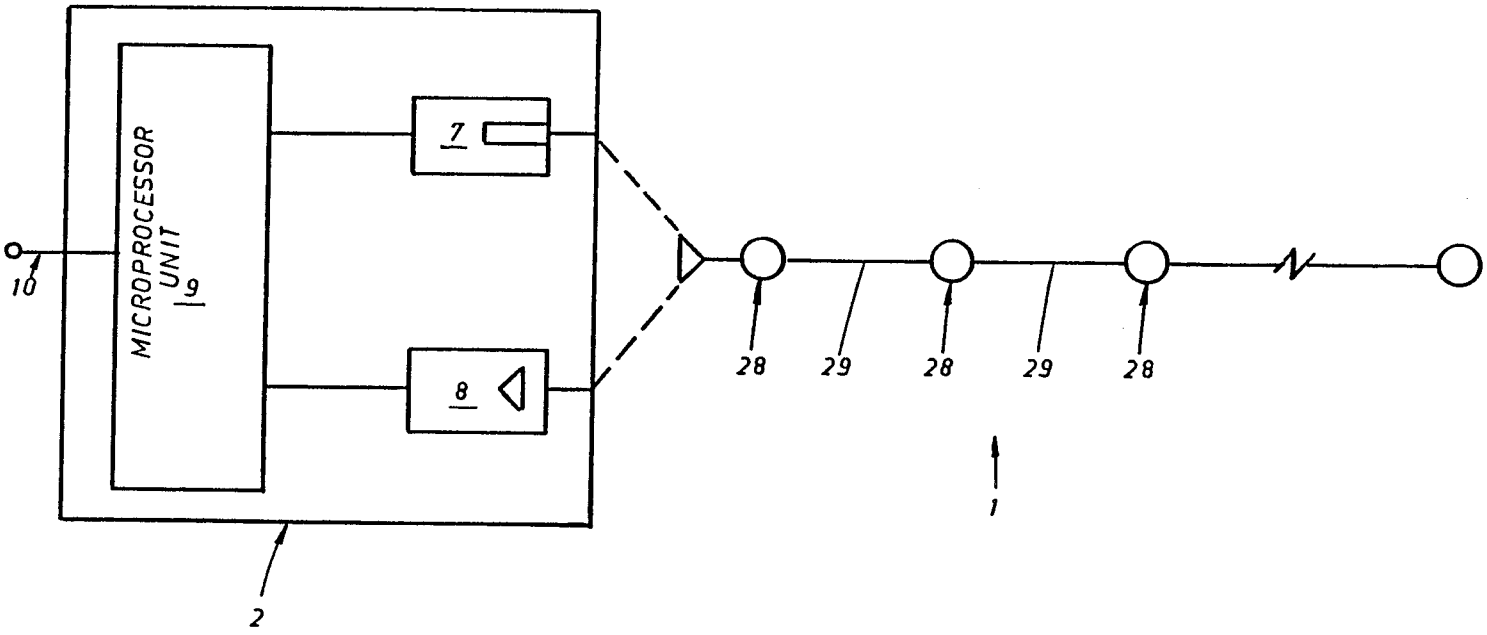
FIG. 6 shows an alternative embodiment of the sensing system of the present invention.

Numerous other modifications may be made to the invention as herein described. For example, the system shown in FIG. 1 may be modified to the simpler serially-connected system shown in FIG. 6. In FIG. 6, each of the detector cells 28 is linked in a 'series' connection with the adjacent detector cells by optical fibers 29. In this alternate embodiment, an electromagnetic energy pulse may be transmitted from the light source 7 and may pass through each of the detector cells 28. A suitable termination may be supplied, for instance of highly reflective material at the last of the detector cells 28. The electromagnetic energy pulse would travel through each of the detector cells 28 and optical fiber links 29, and be reflected at the end of the optical link to the receiver 8. Since the amount of energy returned to the receiver under the conditions when there is no smoke, gas or fire present is known by the microprocessor, the microprocessor can then analyze the received signal in a similar way to the embodiment shown in FIG. 1 to determine the nature of the smoke, gas or fire.

Figure 7:
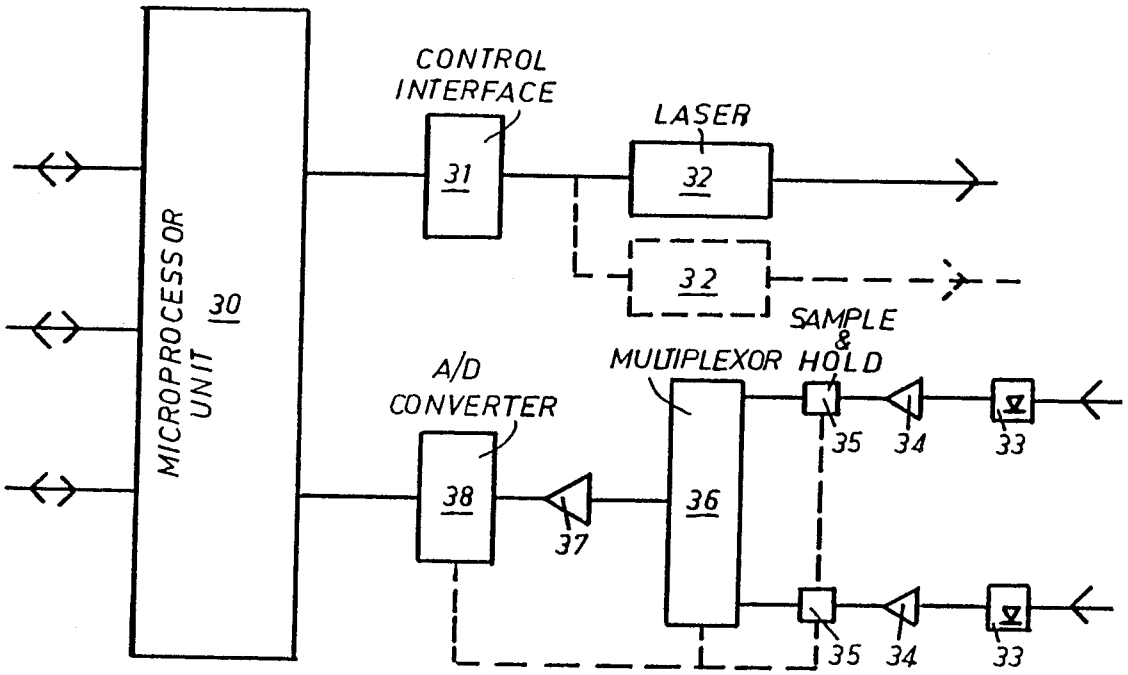
FIG. 7 illustrates the basic feature of an embodiment of a microprocessor used to analyse the presence and nature of gas, smoke or the like in accordance with the present invention.

In FIG. 7, is shown the basic features of an embodiment of an analyzer system in block diagram form. The system comprises the control microporcessor unit 30 which controls the system and analyses the results. The microprocessor 30 has an output to a control interface 31. The control interface 31 controls the emission of electromagnetic energy, shown as lasers 32, into the detection system. After the electromagnetic energy has passed through the series of optical fibers and detection cells, the electromagnetic energy returns to the analyser system either, unchanged indicating the absence of smoke, gas or fire, or, at changed intensity indicating the presence of smoke, gas or fire. On reception of the electromagnetic energy signal from the detection system, the signal is firstly converted into an electrical signal by a suitable photodetector 33. The electrical signal may then pass through an amplifier 34 before being converted into a digital signal for processing by the microprocessor 30. Typically, this may be implemented by the system shown in FIG. 7 consisting of a sample-and-hold block 35, a multiplexer 36, an amplifier 37 and an analog-to-digital converter 38. The microcomputer may then be linked by a hardwire or optical-fiber link to a communications interface for display on a screen, or activation of an alarm or the like, indicating of the presence of smoke, gas or fire. The analysis system is preferably connected to both a mains power supply as well as a standby battery for occasions when there is a power failure or an emergency situation.

In FIG. 8, is shown an analyzer 39 which acts as an optical spectrophotometer. FIG. 8(*a*) illustrates an end view of the analyser 39 showing concave mirrors 41 and 43, FIG. 8(*b*) details a plan view of the analyser 39 showing the optical paths of electromagnetic radiation of the system, and, FIG. 8(*c*) shows an end view of the analyser 39, wherein the electromagnetic radiation enters the slit 40, is reflected onto the diffraction grating 42 and focussed onto the detector array 44. Light returning from the detection cell via the fiber-optic cable is directed into an optical system which has been machined from material having the same refractive index as the core of the optical fiber. This ensures that losses due to reflections from interfaces of differing refractive indices are minimized. The light from the optical fiber passes through the entrance slit 40, and is reflected from the concave mirror 41, onto the diffraction grating 42, where the light is diffracted at different angles corresponding to the wavelengths of the spectra of the light.

The diffracted light falls on the concave mirror 43, and is focussed onto the detector array 44, where the image of the slit appears as a series of lines at the wavelengths of the spectra of the light source. The intensity of these lines will vary, dependent on the degree of absorption of the light at the wavelengths of interest.

The letters f, r and x in FIG. 8 illustrate the preferred optical lengths of the system. The radius of curvature of the concave mirrors is represent by r, r being, for example, typically 112 mm. The focal length f of the concave mirror is equal to 0.5 r, and x is the optimum distance between a mirror and a diffraction grating in a Czerny-Turner spectrophotometer mount which gives the most compact design, which is equal to 0.423r. The mirrors may be off-axis paraboloids.

The detector array 44, may be scanned by a charge coupled device shift register, under control of a microprocessor, and the output of the charged coupled device being an analog video signal in which the amplitude of the signal is an analog representation of the intensity of light falling on the detectors and the position in time represents the location of an element in the detector array. Since the location of each of the elements in the detector array is known relative to the diffraction wavelength then this video signal may be said to represent a spectrograph of light returned from the detection cell.

The amplitude of the video signal at various wavelengths is influenced by the transmission characteristics of the fiber-optic cable and any device or substance in the optical path including the characteristics of the light source and the detector array. To compensate for these variations an equalizing video amplifier is preferably included in the signal path, described hereinafter with reference to FIGS. 9(*a*) and 9(*b*).

In FIG. 9, comprising FIGS. 9(*a*) and 9(*b*), is shown a block diagram of the microprocessor and the associated control logic for the transmission and reception and analysis of the electromagnetic radiation.

As there are critical timings which cannot be determined by the microprocessor 46 alone it is necessary to implement this design using a high frequency crystal controlled oscillator, 47, and timebase circuit 48, to provide all the critical timing and sequencing signals for the system. The timebase circuit 48 also monitors the operation of the microprocessor 46 in that it maintains a 'watchdog' circuit which will raise a 'fault' alarm should the microprocessor 46 fail or become locked in program loop.

At power up, the microprocessor 46 is reset and then vectors to a start address from where it performs a hardware configuration routine and a self test diagnostic to ensure that the hardware is correctly configured and operational, as defined by tables in the ROM 50. The communications interface, 56, is activated so that an engineer may interact with the system. The random access memory 51, resides on the Data bus 61, and the Address bus 57. A fast memory controller 52, and a bus switch 54, are interposed between the data and address buses 61 and 57 respectively, and the video memory 53. The bus switch 54, is necessary to prevent bus contention between the memories. The video memory is required to buffer the output of the A/D convertor 60, which has a conversion rate of 2.0E7/Sec. (20,000,000). The microprocessor 46 loads the timebase 48 with the transmit and receive parameters; wavelength, pulse width, pulse repetition frequency, receiver gating time, and the top end of the video memory with the gain control tables for the control of the video equalizing amplifier 58, which verifies the information and then initiates the transmit and receive sequence. The timebase 48 executes the sequence, starting the A/D convertor 60 and timing the reception of the returned signals. The results of the conversions are time-tagged and stored in the video memory 53.

At the completion of the transmit/receive sequence, which may be one or a number of iterative cycles of the timebase, the results of the conversions are down loaded to the RAM, 51. The microprocessor 48 then analyzes this data, stores the results, and signals an appropriate response to a poll from the watching station.

The gain of the equalising video amplifier 58 may be controlled by a digital signal from a gain control unit 59 which is derived by the microprocessor 46 from a set of tables stored in memory of the microprocessor 46 at the time of commissioning of the installation. These tables are not fixed but are variable within defined limits. The microprocessor 46 may be provided with auxiliary inputs such that it is able to learn the environment of the detection cells 44 and automatically adjust the system performance to optimise the detection and minimize false alarms. Because the system is dynamic, that is, continuously testing the functionality of the detector 44, it is able to actively monitor its own performance by testing the absorption of known substances in the optical paths.

The equalized video signal is converted to digital form by a very fast analogue to digital convertor 60 and the results of these conversions are passed by bus 55 and stored in a multiport video memory 53. This information is analysed by the signal processor 45. The analysis may be performed by simply matching the current information with the detection tables as in a set-point controller. A more sophisticated approach is to use an adaptive predictive algorithm which will not only compensate for changes in the environment but be able to enhance the detection of specific substances by correlating the absorption spectra at a number of wavelengths.

At this time, the computational speed of most available microprocessors is not sufficiently fast to enable this design to be economically implemented without the addition of high speed ancillary logic to control the transmission and reception of the nanosecond pulses of electromagnetic energy required in the realisation of the reflectometry section of the design. To overcome this limitation a high speed timebase circuit design has been implemented such that all critical timings are independent of the microprocessor cycle time.

These timings include, the initiation of a transmission, the width of the transmitted pulse, the selection of the wavelength or the transmitted signal, the gating of the receiving section, the timing of the transit of a pulse through the network of detectors, the adjustment of the gain of the equalizing video amplifier 58 and other such timings as may be considered critical to the proper operation of the system.

There are circumstances in which the absorption wavelengths of certain substances of interest fall outside the passband of the available optical fiber. In these cases a modified form of the detection cell has been designed in which a band of wavelengths which would normally fall outside the passband of the fiber-optic cable are translated within the passband of the optical fiber. To achieve this effect a crystal of non-linear optical material, such as KDP, is included in the optical path. This crystal is pumped by coherent radiation at two or more wavelengths to produce the sum and difference wavelengths of the pump beams. The desired spectra is selected by filters or gratings and then used to probe the absorption spectra of the substances in the detection cell. The resultant absorption spectra is translated by similar means or be reflected onto the crystal to a band of wavelengths which fall within the passband of the optical fiber.

In FIG. 10, is shown a preferred embodiment of a detection cell design. Whilst the detection cell of the present invention may take a variety of forms to achieve the required functions of the present invention, a torus, as illustrated in FIG. 10 achieves an optimum design choice. Whilst the arrangement of FIG. 2 demonstrates the principle of the detection cell, it is not the most optimum arrangement for both production and aesthetic considerations. A more compact design is to fold the optics into a truncated torus. This is a much improved packaging method which achieves optimum gas flow and which is much more suitable for mass production, for instance, by injection molding.

Figure 2A:
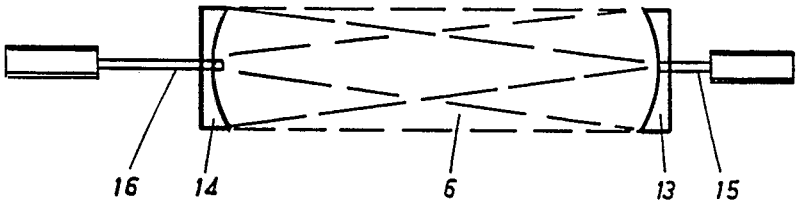
Figure 2B:
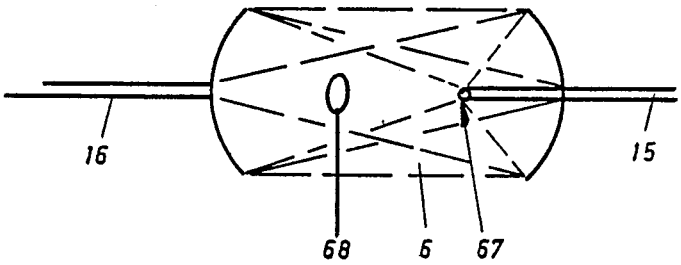

A possible variation to the basic concepts of the detection cells of FIGS. 2*a* and 2*b*, is to arrange the mirrors as surfaces of a modified torus, generally designated by the numberal 62 in FIG. 10(*a*). The torus is comprised of essentially an inner mirrored surface 63 and an outer mirrored surface 64 in facing relationship. In FIG. 10(*a*) is shown an isometric view of a detection cell 62, provided with an input 71, output 72, a port 69 to the next detection cell and a port 70 from the next detection cell. FIG. 10(*b*), illustrates an isometric sectional view of the torus-shaped detection cell. Rather than the torus being fully enclosed, the upper and lower ends thereof, 65 and 66 respectively are vented to the surrounding environment, such that smoke, gas or the like to be detected may pass through the detection cell 62. The input 77 is passed via a fiber-optic splitter 76 to the launcher 73 provided circumferentially around the outer mirror 64. The resultant optical signal is received by the probe 74, provided circumferentially around mirror 63, to be transmitted to the output 78 via the fiber-optic combiner 75. FIG. 10(*c*) is a representation of the preferred design choices of the optical path therein. In FIG. 10(*c*), AB represents the radius of curvature of mirror 64, CD represents the radius of curvature of mirror 65, and DB is the focal length of mirrors 63 and 64, which is equal to half the radius of curvature, for this design. Whilst FIGS. 2(*a*) and 2(*b*) incorporate microspheres in the optical path to improve the coupling through the detection cell, when the detection cell is arranged in the torus form of FIG. 10, these are preferably replaced by a ring launcher 73 on the mid plane of the detection cell 62, and, as in FIG. 2(*b*), the probe 67 is equivalently replaced by a concentrator ring 74. The pattern of operation of light rays within the torus 62 is equivalent to those shown in FIGS. 2(*a*) and 2(*b*) in the vertical plane, but the interferance rings will now lie in the horizontal plane.

Applications of the sensing system for the detection and analysis of gas, smoke or fire in accordance with the present invention are numerous, and include the following:

Industrial and commercial premises;
Petroleum refineries;
Mines and mine processing plants;
Ordinance and munitions factories;
Explosives factories;
Natural gas wells and processing plants;
Gasworks;
Oil rigs and gas wells;
Dangerous goods stores;
Explosives magazines;
Chemical works;
Sewage works;
Hospitals; and,
Hotels and residential premises.

In fact, any general situation wherein the detection of gas, smoke or fire is required, would render the present invention useful.

Although there have been described herein specific arrangements of a sensing system for detection and analysis of gas, smoke or fire in accordance with the present invention for the purpose of illustrating the manner in which the invention may be used to advantage, it will be appreciated that the invention is not limited thereto. Accordingly, numerous variations and modifications will be apparent to those skilled in the art which should be considered to be within the spirit and scope of the invention as herein described.

I claim:

1. A sensor system, comprising:

a source adapted to emit electromagnetic energy signals of predetermined frequencies, detection means having at least one detection cell adapted to admit gaseous substances into the path of said electromagnetic energy signals, a receiver adapted to receive resultant electromagnetic energy signals after transmission of said electromagnetic energy signals through said detection means;

an optical fiber circuit connecting said detection means to said source and to said receiver, and microprocessor means adapted to control the emission of said electromagnetic energy signals of predetermined frequencies and to process said resultant electomagnetic energy signals returned to said receiver by spectrophotometry to identify the composition of said gaseous substances.

2. The sensor system of claim 1 wherein said detection means includes at least two detection cells connected in parallel by fiber-optic splitters/combiners, and wherein said microprocessor means is further adapted to control the timing of emission of said electromagnetic energy signals from said source and to analyze said resultant electromagnetic energy signals returned to said receiver by reflectometry, such that the particular detection cell from which the components of said resultant electromagnetic energy signals are returned therefrom can be identified.

3. A sensor system comprising a source adapted to emit electromagnetic energy signals, detection means having at least two detection cells adapted to admit gaseous substances into the path of said electromagnetic energy signals, a receiver adapted to receive resultant electromagnetic energy signals after transmission of said electromagnetic energy signals through said detection means, an optical fiber circuit connecting said detection means to said light source and to said receiver, and microprocessor means adapted to control the timing of emission of said electromagnetic energy signals from said source, and to analyze said resultant electromagnetic energy signals returned to said receiver by reflectomentry, such that the particular detection cell from which said resultant electromagnetic energy signals are returned therefrom can be identified.

4. The sensor system of claim 3 wherein said microprocessor means is further adapted to control the emission of predetermined frequencies of said electromagnetic energy signals from source, and to analyze said resultant electromagnetic signal returned to said receiver by spectrophotometry to identify the composition of said gaseous substances.

5. The sensor system of claims 1, 2, 3 or 4 wherein each of said detection cells is mounted in a labyrinthine housing.

6. The sensor system of claims 1, 2, 3 or 4 wherein said detection cells are provided in the shape of a torus.

7. The sensor system of claims 1, 2, 3 or 4 which further comprises temperature sensing means for detecting thermal changes at a remote location.

8. The sensor system of claim 1, 2, 3 or 4 wherein each of said detection cells comprises two concave mirrors placed in opposed relationship, each of said mirrors being provided with a microsphere to transmit and receive electromagnetic radiation through optical fibers connected thereto.

9. The sensor system of claim 7, wherein said temperature sensing means comprises a thermal sensing plate for sensing ambient temperature changes, and a microsphere of temperature-dependent optical material provided within said optical fiber circuit and in operative relation to said thermal sensing plate, so that thermal changes sensed by said thermal sensing plate are conveyed to said microsphere to consequently change the optical properties of said optical fiber link.

10. The sensor system of claim 8, wherein each of said concave mirrors is mounted on a common axis and separated by a distance which is slightly less than the focal length of the mirrors.

11. The sensor system of claim 10, wherein each of said detection cells includes an obscuration disc on said axis of said mirrors to attenuate direct rays on said axis and minimize reflections into said optical fibers.

* * * * *